US011001051B2

(12) United States Patent
Cho et al.

(10) Patent No.: US 11,001,051 B2
(45) Date of Patent: May 11, 2021

(54) MULTI-COLOR GRAVURE OFFSET PRINTING DEVICE AND PRINTING METHOD

(71) Applicants: Ha Young Lee, Seoul (KR); Teruji Cho, Ibaraki (JP); Hidetsura Cho, Miyagi (JP); Shuichi Sato, Chiba (JP)

(72) Inventors: Teruji Cho, Ibaraki (JP); Hidetsura Cho, Sendai (JP); Shuichi Sato, Chiba (JP)

(73) Assignees: Ha Young Lee, Seoul (KR); Hidetsura Cho, Sendai (JP); Shuichi Sato, Chiba (JP); Yukie Cho, Tsukuba (JP); Yuichiro Cho, Tsukuba (JP); Erika Kobayashi, Moka (JP)

( * ) Notice: Subject to any disclaimer, the term of this patent is extended or adjusted under 35 U.S.C. 154(b) by 379 days.

(21) Appl. No.: 16/097,544

(22) PCT Filed: Apr. 27, 2017

(86) PCT No.: PCT/KR2017/004527
§ 371 (c)(1),
(2) Date: Oct. 29, 2018

(87) PCT Pub. No.: WO2017/188767
PCT Pub. Date: Nov. 2, 2017

(65) Prior Publication Data

US 2019/0152213 A1 May 23, 2019

(51) Int. Cl.
*B41F 3/38* (2006.01)
*B41F 17/00* (2006.01)
(Continued)

(52) U.S. Cl.
CPC ..... *B41F 3/38* (2013.01); *B41F 3/36* (2013.01); *B41F 17/006* (2013.01); *B41N 10/06* (2013.01); *B41M 1/10* (2013.01)

(58) Field of Classification Search
CPC . B41F 3/36; B41F 3/38; B41F 17/006; B41N 10/06; B41M 1/10
See application file for complete search history.

(56) References Cited

U.S. PATENT DOCUMENTS 5,335,595 A * 8/1994 Yamashita ..... B41F 3/36 101/158
6,276,266 B1 * 8/2001 Dietz ..... B41F 17/001 101/41
(Continued)

FOREIGN PATENT DOCUMENTS

JP 05-169626 A 7/1993
JP H09-277491 A 10/1997
(Continued)

OTHER PUBLICATIONS

International Search Report issued in PCT/KR2017/004527; dated Aug. 18, 2017.

*Primary Examiner* — David H Banh
(74) *Attorney, Agent, or Firm* — Studebaker & Brackett PC

(57) ABSTRACT

Disclosed is related to a printing device for performing a multi-color gravure offset printing operation in one rotation of a gravure offset roll for various shapes of printing material, and a method therefor. The printing device includes at least: a blanket roll having a cylindrical shape and moving in a first direction while rotating; an ink transfer unit including one or more ink transfer plates which is in contact with a lower end of the blanket roll; a squeeze unit moving in a second direction in a state in which one end thereof comes in contact with the ink transfer plate, wherein the second direction forms a predetermined angle with respect to the first direction or is orthogonal to the first direction. According to the present invention, an effect of
(Continued)

enabling gravure offset printing in one printing cycle on various shapes of printing material is provided.

10 Claims, 12 Drawing Sheets

(51) Int. Cl.

| | |
|---|---|
| ***B41F 3/36*** | (2006.01) |
| ***B41N 10/06*** | (2006.01) |
| *B41M 1/10* | (2006.01) |

(56) References Cited

U.S. PATENT DOCUMENTS

| | | | | |
|---|---|---|---|---|
| 2004/0123753 | A1* | 7/2004 | Yoo | B41M 7/0081 101/158 |
| 2007/0214977 | A1* | 9/2007 | Okamoto | B41M 1/10 101/170 |
| 2012/0292307 | A1* | 11/2012 | Kim | H05B 3/84 219/522 |
| 2015/0352829 | A1* | 12/2015 | Sente | B41F 3/20 101/153 |
| 2017/0050426 | A1* | 2/2017 | St. Pierre | B41F 15/0881 |

FOREIGN PATENT DOCUMENTS

| | | | |
|---|---|---|---|
| JP | 3731937 | B2 | 1/2006 |
| JP | 2008-168578 | A | 7/2008 |
| JP | 2014-033013 | A | 2/2014 |
| JP | 5493908 | B2 | 5/2014 |
| KR | 10-2016-0007122 | A | 1/2016 |

* cited by examiner

MULTI-COLOR GRAVURE OFFSET PRINTING DEVICE AND PRINTING METHOD

TECHNICAL FIELD

The present invention relates to a printing device for performing multi-color gravure offset printing on printing materials with various shapes in one rotation (hereinafter, referred to as one printing cycle) of a gravure offset roll and a method thereof, and more specifically, to a multi-color gravure offset printing device which appropriately prints various colors on a material having a flat surface, a three-dimensional stereoscopic printing material having a curved structure, including a plastic bottle shape or an asymmetrical shape with thickness, a three-dimensional stereoscopic material made by a three-dimensional (3D) printer, and the like, in an overlapping manner and which dries the multi-color gravure printed materials after the multi-color gravure printing is performed in one printing cycle, and a printing method.

BACKGROUND ART

Multi-color gravure offset printing methods include a method of installing a plurality of plates around a drum with a single large radius described in Japanese Patent Application Laid-Open No. H09-277491 and a method of disposing a plurality of drums in parallel to each other (Japanese Patent Application Laid-Open No. 2008-168578), and the like. However, recently, there are problems with adjusting a position of a drum itself and ensuring reproducibility, maintaining precision and reproducibility of printing at a width of less than or equal to 100 μm when the printing material is moved in a conveyor manner, and the like. Further, it is highly likely that various problems with precision caused when a plurality of drums are used, such as distortion of parallel precision of installation positions of the plurality of drums caused by change in temperature, determination of parallel position, and the like, will occur. Although the width is less than or equal to 100 μm, due to the thickness being a few micrometers, there are problems, such as excessive electric resistance or a lack of sufficient color density. Furthermore, in the high functional printing device satisfying the problem, there are problems of difficulty of automation and parallel processing or change in quality of printing occurring during printing as time elapses from the view point of economically high efficiency printing. There are many factors that block supply of gravure offset printing when compared to a silk printing method, including a problem in which the roll is damaged due to solidification of a ultra violet (UV) ink in a drying process when UV rays touch a part of blanket roll and a problem in which printing is distorted due to a thickness of printing in a serial printing method.

PATENT DOCUMENT

1. Japanese Patent Application Laid-Open No. H09-277491
2. Japanese Patent Application Laid-Open No. 2008-168578

Technical Problem

The present invention is directed to providing a printing device for performing gravure offset printing on materials having a flat surface and a stereoscopic shape, such as a cylindrical surface or a three-dimensional surface, using one blanket roll in one printing cycle (hereinafter, referred to as one rotation of a blanket roll), and a method thereof.

The present invention is also directed to providing a printing device for printing various colors that a printer may print within one printing cycle.

Technical Solution

One aspect of the present invention provides a gravure offset printing device which includes a blanket roll having a cylindrical shape and moving in a first direction while rotating, an ink transfer unit including at least one ink transfer plate which is in contact with a lower end of the blanket roll, and a squeeze unit moving in a second direction while one end thereof is in contact with the ink transfer plate, wherein the second direction is inclined a predetermined angle or orthogonal to the first direction.

Another aspect of the present invention provides a gravure offset printing device which includes a blanket roll, wherein ink is transferred to a surface of the blanket roll and the blanket roll horizontally moves in a first direction while rotating and a printing material positioned to face the blanket roll in the first direction, wherein the printing material moves a predetermined length in the first direction.

Advantageous Effects

According to the present invention, gravure offset printing can be performed on printing materials in various shapes in one printing cycle. Particularly, the gravure offset printing can be performed even on a three-dimensional stereoscopic printing material with thickness including a cylindrical printing material and a curved structure as well as a flat printing material.

According to the present invention, inks of various colors can be printed at the same position on each printing material to overlap each other, and thus a required color can be printed in one printing cycle by combining the colors of ink.

Further, according to the present invention, since mass printing can be performed on a plurality of printing materials in one printing cycle, a speed of printing can be increased, and thus economic feasibility can be increased.

MODES OF THE INVENTION

A gravure offset printing device, which is a gravure offset printing device, including a blanket roll having a cylindrical shape and horizontally moving in a first direction while rotating, and at least one ink transfer plate which is in contact with a lower end of the blanket roll, includes a blade moving in a second direction while one end thereof is in contact with the ink transfer plate, wherein the second direction has a predetermined angle with respect to the first direction.

Hereinafter, exemplary embodiments of the present invention will be described in detail with reference to the accompanying drawings.

Figure 1:
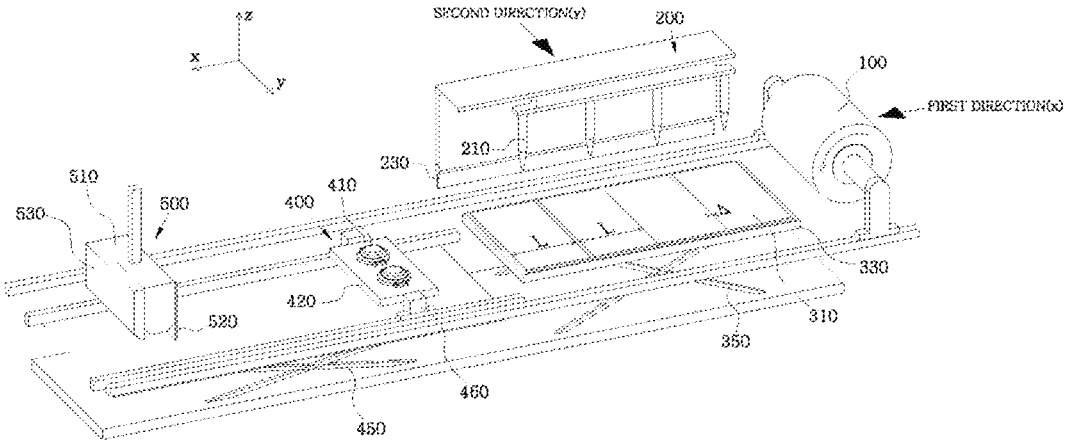
FIG. 1 illustrates an overall configuration of a gravure offset printing device according to the present invention.

FIG. 1 illustrates an overall configuration of a gravure offset printing device according to the present invention.

The gravure offset printing device of the present invention includes a blanket roll 100 having a cylindrical shape and moving along a pair of straight rails, which are parallel to each other, while rotating, an ink supplying unit 200 uniformly applying ink to an ink transfer unit, at least one ink transfer unit 300 positioned in contact with a lower end of the blanket roll and transferring the ink to the blanket roll in a printing pattern to be printed, and a printing unit 400 which is positioned in front of the blanket roll in a movement direction and on which a printing material on which the ink (the printing pattern) transferred to the blanket roll is printed is positioned, and further includes a drying unit 600 drying and cooling the ink printed on the printing material.

Hereinafter, the blanket roll 100 will be described in detail.

The blanket roll 100 (hereinafter, referred to as a roll for convenience of description) has a cylindrical shape (precisely, a nearly cylindrical shape having elasticity rather than a complete cylindrical shape, hereinafter referred to as "cylindrical shape" for convenience of description), and moves horizontally in a first direction shown in FIG. 1 while rotating in a counterclockwise direction. Although not shown in the drawings, the roll 100 may be moved along a guide rail 110 by rotating so as to allow the roll to move horizontally by the same length as a rotation length of the roll. That is, the blanket roll 100 moves horizontally in the first direction at the same speed as a rotation speed.

A material of the blanket roll 100 is a so-called rubber roll containing, for example, any one of Teflon, silicone, vinyl chloride, urethane, epoxy, and the like, or a combination thereof, as a main component. As another example, the material of the roll may be a combination of the main component and an inorganic element.

The material, which depends on intermolecular force between the ink and a printing material, is closely related to a condition in which a difference between entropies of ink per unit volume and each material of the printing material and the product of pressure and volume is small. Particularly, when the intermolecular force is strong, such a condition actually becomes a required condition.

The material of printing material may be, for example, a great variety of materials such as an elastomer, an organic matter such as plastic, glass, a silicon substrate used for a semiconductor, a solar cell, and the like, a metal, paper, etc.

A Japanese Industrial Standards (JIS)-A hardness of the blanket roll 100 is greater than or equal to 0 and less than or equal to 40 at room temperature (about 25° C.), and particularly, the blanket roll has a thickness 0.5 to 40 times a thickness of a stereoscopic printing material. When a metal shaft, for example aluminum, is in the center of the blanket roll, the thickness of the roll refers to a portion excluding the central metal shaft.

A rotation speed (a movement speed in a first direction) of the roll on a transfer unit 300 while transferring is in a range of 0.5 to 12 m/min. In the gravure offset printing, the rotation speed of the roll, which is very important when ink is transferred to the blanket roll, satisfies fluid movement equation for ink. Such a feature is a fundamental difference from a pad printing method, a tampo printing method, or a screen printing method.

That is, since the blanket roll has an appropriate length of Nip, it is preferable that a roll with small intermolecular force has a speed of 0.5 to 12 m/min in a first direction when roll printing is performed in order to secure an increasing fluid physical movement of the ink according to a necessity, for example in the case of conductive ink containing a noble metal such as silver.

Further, it is preferable that the intermolecular force between the ink transferred to the roll and the printing material is selected based on the entropies and the like. Thus, the movement of the ink used for printing can be facilitated and optimized.

Furthermore, as a main difference between the method according to the present invention and other printing methods, the present invention includes a method of precisely transferring ink from a plate to a gravure roll to secure precise reproducibility, and thus complicated overlapping printing can be easily performed at high speed as described below.

Hereinafter, the ink supplying unit 200 will be described in detail with reference to FIG. 2.

Only one color of ink I may be used, but in the present invention, a plurality of colors (ink portions I1, I2, I3, and I4 in four colors in the accompanying drawings and following embodiments) are used, assuming multi-color printing. As seen in FIG. 2 for the sake of description, the portions are referred to as the first ink portion I1, the second ink portion I2, the third ink portion I3, and the fourth ink portion I4 from the right. As exemplary embodiments, the four colors are based on a cyan, magenta, yellow, key plate/black (CMYK) color table, and more preferably, ultra violet (UV) varnish and the like may be added as the last ink to reinforce resistance to alcohol.

The inks in various colors simultaneously fall down (drip down) through a plurality of ink syringes 210 disposed at predetermined gaps L+Δ. The plurality of ink syringes 210 are moved by a horizontal moving unit, such as a linear actuator or the like, by a width L of the required ink in the first direction (x direction) so that the inks linearly fall down. Further, the ink is referred to as a various colored ink, but in one embodiment of the present invention includes a transparent inorganic matter, such as varnish, in addition to ink or ink having a different feature although it has the same color.

A blade of a squeeze unit 230 moves while being in contact with a transfer plate 310 of the ink transfer unit in a second direction y orthogonal to (or a predetermined angle) a movement direction (a first direction x) of the blanket roll 100, and an engraved pattern in the transfer plate is filled with the ink linearly supplied by the ink syringe.

In this case, a width of the supplied ink should be adjusted so that various colors are not mixed. In the embodiment of the present invention, for simplicity of description, both a width of supplied ink and a width of an ink transfer plate 310 in which the engraved pattern is formed are described as L. That is, the inks are linearly supplied by the width L of the ink transfer plate 310, but the ink portions may not have the same width L according to a purpose thereof.

Figure 2:
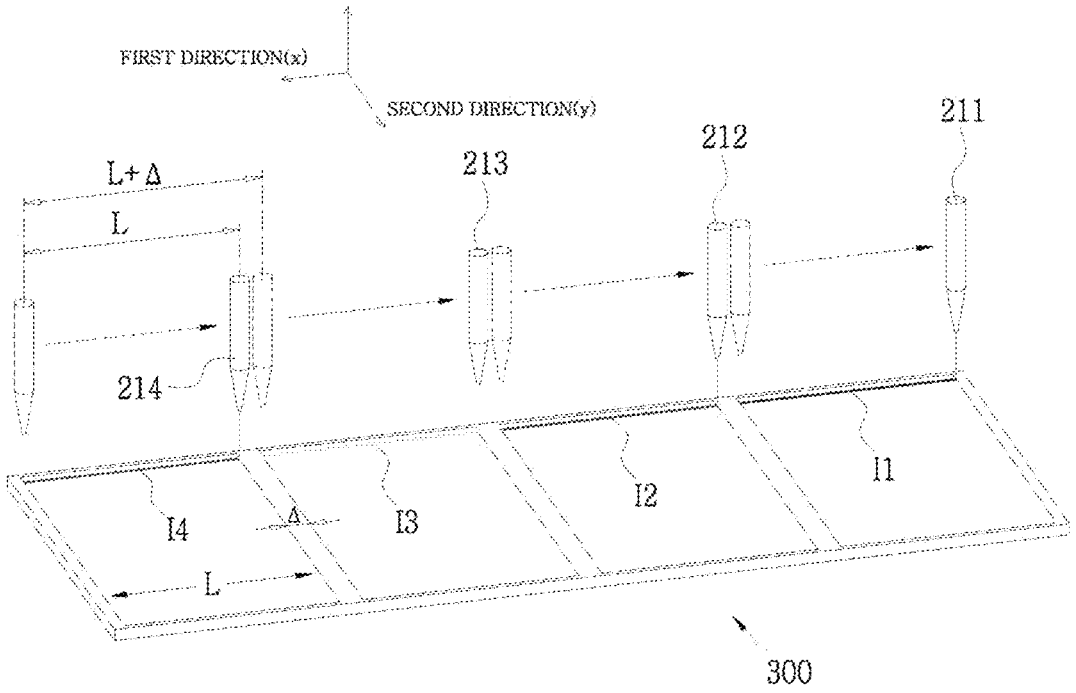
FIG. 2 illustrates a state in which ink is supplied from an ink supplying unit to a transfer unit.

As shown in FIG. 2, the plurality of ink transfer plates 310 may be provided. In this case, in FIG. 2, the ink transfer plates 310 may be disposed on a transfer plate support 330 in parallel at predetermined gaps Δ so that the inks are not mixed, and for convenience of description, the ink transfer plate 310 has a rectangular shape but does not necessarily have a rectangular shape and may have various shapes as needed.

Hereinafter, a squeeze process of filling an engraved pattern in the ink transfer plate 310 with ink through a blade will be described with reference to FIGS. 3 and 4.

Figure 3:
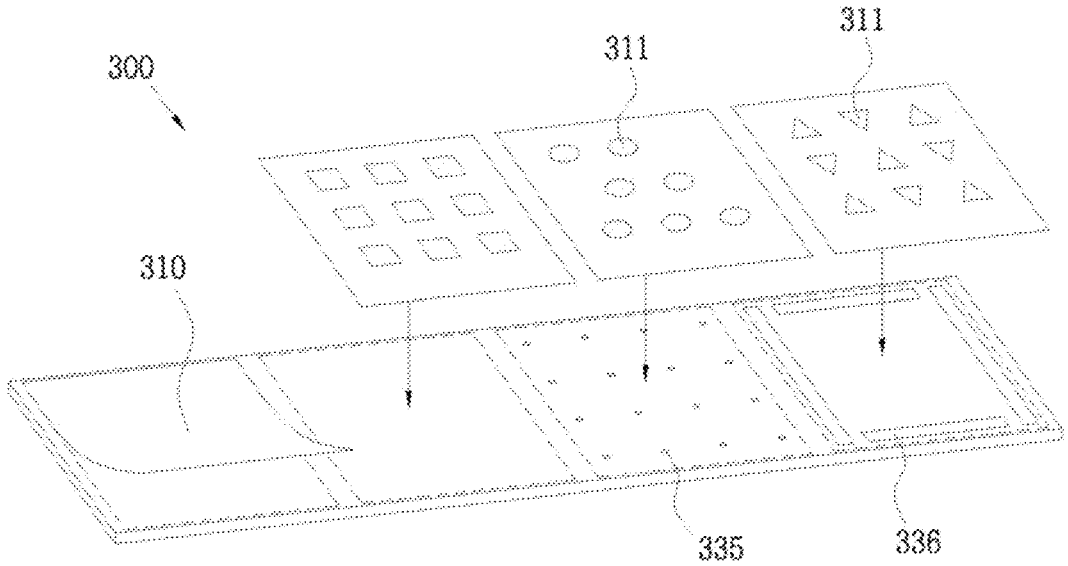
FIG. 3 is a view illustrating a state in which a transfer plate in which a fine engraved pattern is printed is put on a transfer plate support of the transfer unit.

FIG. 3 shows four ink transfer plates 310 disposed on the plate-shaped transfer plate support 330 of the ink transfer unit 300.

Preferably, the ink transfer plate 310 may be a metal plate, a resin film, or the like in which a fine engraved pattern may be formed.

The ink transfer unit 300, configured to transfer ink in an engraved pattern 311 to a surface of the blanket roll 100, includes at least one ink transfer plate 310 fixed on the plate-shaped support 330. Since the ink transfer plate 310 transfers the ink to the roll 100, the ink transfer plate should be fixed at an exact position to perform multi-color printing as described below.

As a first fixing method of fixing the ink transfer plate 310 on the support, the method may allow the ink transfer plate 310 made of a film material to be fixed on the support 330 not to move by generating a vacuous pressure generated by a vacuum generating unit, which is not shown, through a vacuous hole 335. As a second fixing method, the ink transfer plate 310 may be fixed on the support by a double-sided tape 336. Further, as a third fixing method, the ink transfer plate may be fixed by a fixing unit, a rotation fixing screw, or the like, on the support.

Figure 4:
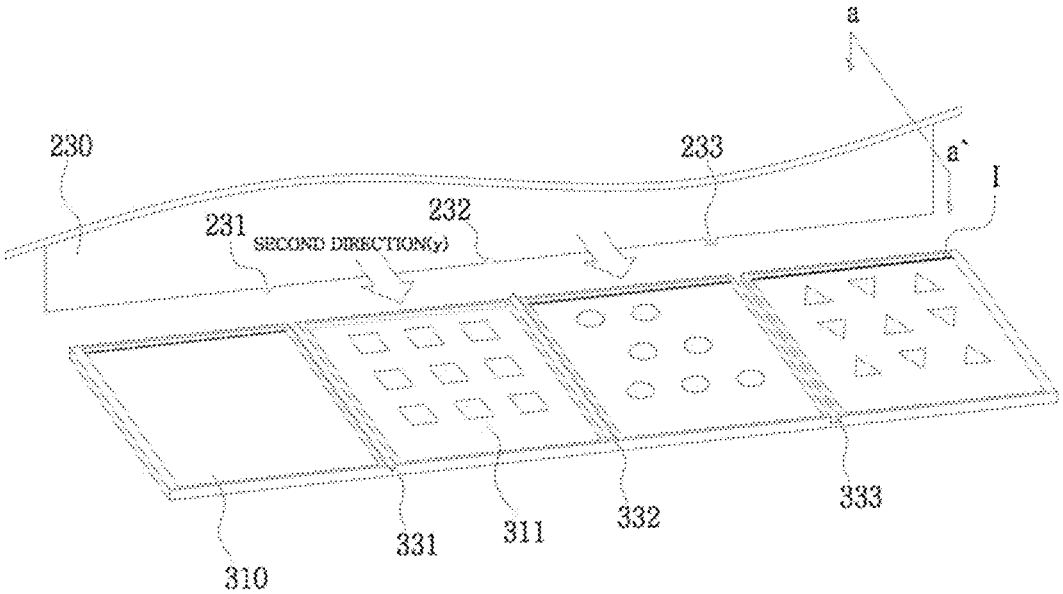
FIG. 4 is a view illustrating an operation state of a blade part.

FIG. 4 shows an engraved pattern in the ink transfer plate 310 to be filled with ink while a blade part of the squeeze unit 230 moves in a second direction having a predetermined angle with respect to the first direction in which the roll 100 moves.

In FIG. 4, the blade of the squeeze unit 230 is orthogonal to the movement direction (a first direction x) of the blanket roll 100, but may not be orthogonal thereto and may have a predetermined angle (an angle which is not 180°, that is, a non-parallel angle).

The ink transfer plate 310 has the engraved pattern 311. A method of forming the engraved pattern in a resin film includes an imprinting method which is already widely known. The imprinting method is well known, and thus detailed description thereof will be omitted.

Figure 5:
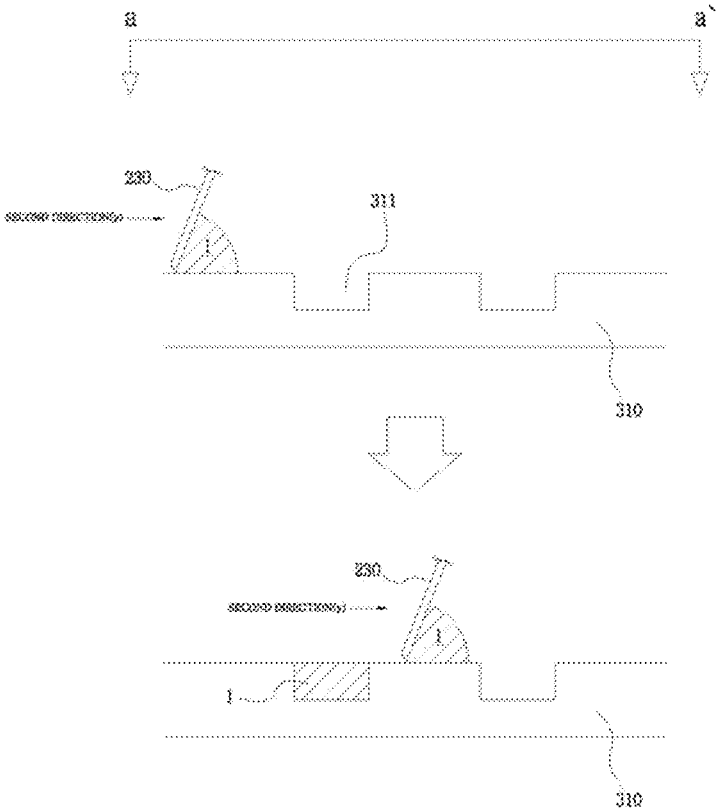
FIG. 5 is a cross-sectional view illustrating the operation state of the blade part.
Figure 6:
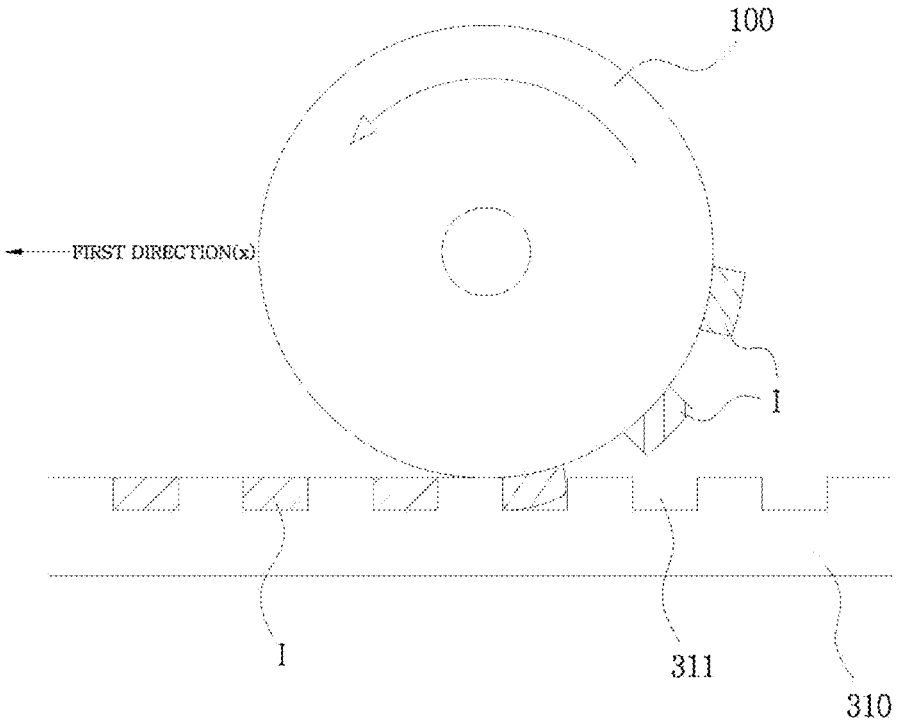
FIG. 6 is a view illustrating a state in which ink is transferred to the transfer plate using a roller.

The squeeze unit 230 allows the fine engraved pattern 311 to be filled with ink while pushing the ink I in the second direction while one end thereof is in contact with the ink transfer plate 310 like a doctor blade having a straight-type one end. FIG. 5 is a view showing the fine engraved pattern 311 to be filled with the ink I. Only the fine engraved pattern 311 is filled with the ink I, and the ink moves and rotates in the first direction while being in contact with the roll 100 and is lifted by intermolecular force and force based on an increasing fluid physical movement so as to be transferred to a surface of the roll (see FIG. 6).

In the exemplary embodiments of the present invention, a part of one end of the blade may have various shapes to correspond a protruding portion or concave parts 331, 332, and 333 of the support 330 formed to prevent colors of the inks from being mixed.

In FIG. 4, the four ink transfer plates 310 are provided, and each of the ink transfer plates 310 has the same width L and has predetermined gaps Δ formed therebetween. As described above, since a supply width of the ink I is L, the inks flow to the ink transfer plates on both sides thereof when the blade moves in the second direction while pushing the inks, and thus there is a problem in which the inks are mixed.

To solve the problem, the transfer plate support 330 includes the concave parts 331 and 333 or the protruding part 332 formed in the gaps Δ to extend in the second direction, thereby preventing the inks from being mixed.

In this case, a part of one end of the blade part may have a shape of the protruding part 232 or the concave part 231 to correspond to the shape of the concave part or the protruding part. When the transfer plate support has shapes of the concave parts 331 and 333, it is not necessary for a part of the blade to not have a shape of the concave part 231. When the transfer plate support has a shape of the protruding part 332, it is preferable that a part of one end of the blade has a shape of the concave part 232 corresponding to the shape of the concave part 332 of the support for easy movement of the blade part.

As another exemplary embodiment, an auxiliary roller and the like may be provided for appropriately cleaning ink remaining after the fine engraving pattern is filled with ink through the blade part. The auxiliary roller, which automatically cleans the ink on the blade part, may be set to clean the ink of the blade part every predetermined number of squeezes according to a viscosity of ink or an amount of used ink.

Another embodiment of a squeeze blade part according to the present invention will be described with reference to FIGS. 7 and 8.

Figure 7:
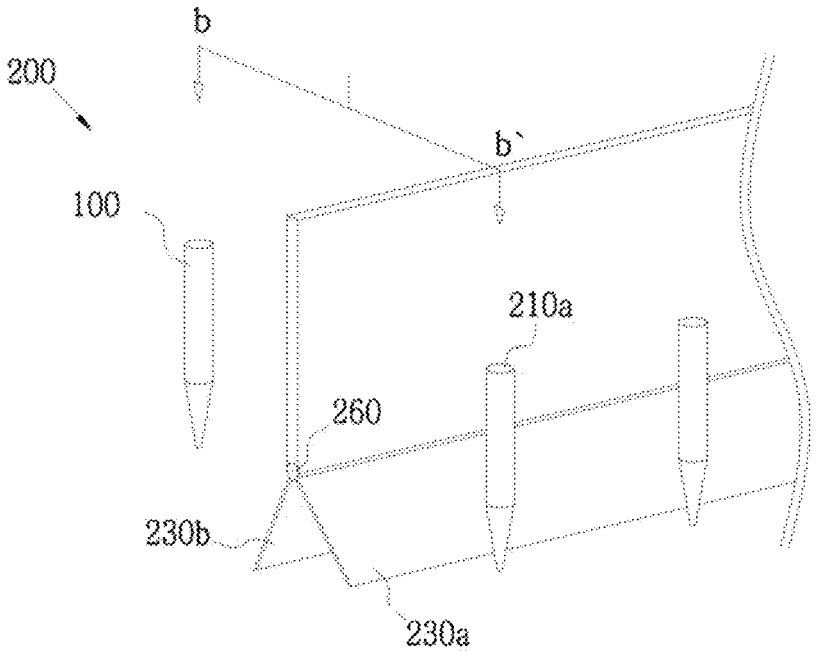
FIGS. 7 and 8 are views illustrating a squeeze blade part according to another embodiment of the present invention.

The squeeze blade part of the ink supplying unit 200, as shown in FIG. 7, has a predetermined angle (a+b) between the blade parts and includes a first blade 230*a* and a second blade 230*b* (hereinafter, referred to as double blades) disposed to be inclined with respect to a blade rotating part 260. In this case, the ink syringes 210 include a first ink syringe 210*a* disposed on a first blade side with respect to the blade rotating part 260 and a second ink syringe 210*b* disposed on a second blade side. Thus, even when the ink supplying unit 200 moves the ink in the second direction and returns to an original position, ink supplying and squeezing operations can be performed.

Hereinafter, an operation of the double blade part will be described with reference to FIG. 8.

FIG. 8A shows a cross-section taken along line b-b' of the ink supplying unit 200 in FIG. 7 when the roll 100 supplies first ink before entering the transfer unit. The first ink syringe 210*a* supplies ink to the transfer unit, and one end of the second blade 230*b* moves in the second direction while being in contact with the transfer plate 310. In this case, the second ink syringe 210*b* does not supply ink. The blade rotating part 260 rotates so that one end of the second blade is in contact with the transfer plate 310, and the second blade has a predetermined angle b with respect to a vertical axis based on the blade rotating unit. In this case, the first blade 230*a* has an angle a (a>b) which is greater than an angle b of the second blade 230*b* with respect to the vertical axis of the blade rotating unit so that one end thereof is not in contact with the transfer unit.

FIG. 8B shows tasks of supplying and squeezing ink while the ink supplying unit 200 returns to the original position after the first ink is supplied and the roll 100 passes through the transfer unit. Contrary to the case shown in FIG. 8A, the second ink syringe 210*b* supplies ink to the transfer unit and moves in a direction opposite to the second direction while one end of the first blade 230*a* is in contact with the transfer plate 310. In this case, one end of the second blade 230*b* is not in contact with the transfer unit, but the blade rotating unit rotates so that one end of the first blade 230*a* is in contact with the transfer unit.

Figure 8:
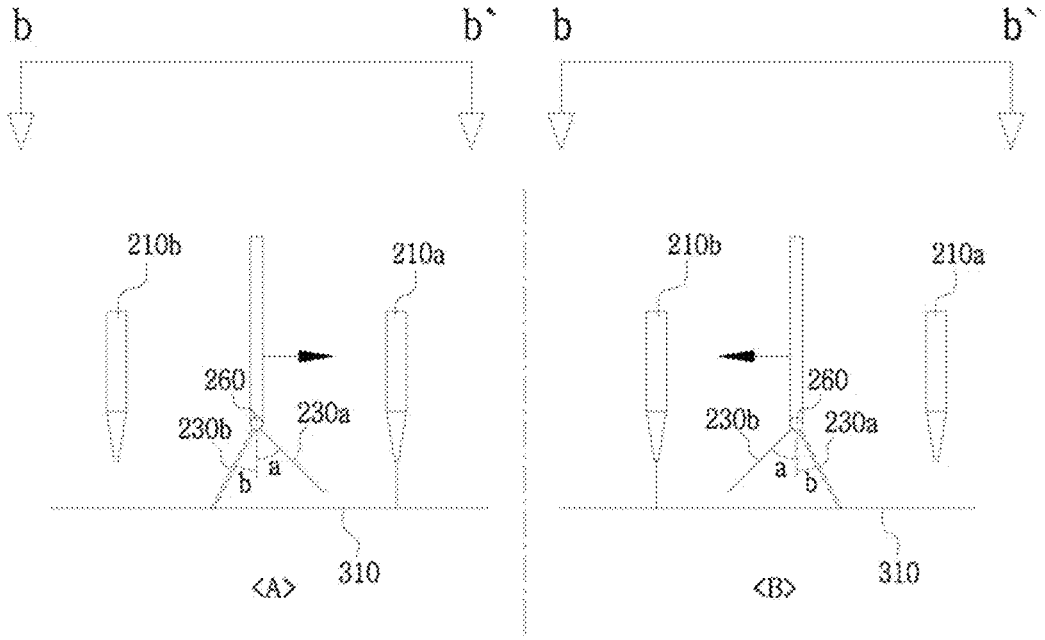

According to configurations of the double blades shown in FIGS. 7 and 8, additional ink for the next ink transferring can be supplied as soon as the ink supplying unit 200 returns to the original position after supplying of the first ink, and thus efficiency and economic feasibility of the ink supply task can be increased. Particularly, tasks of printing on printing materials and supplying and squeezing ink are independently performed, and thus economic feasibility can be remarkably increased due to workability and time reduction of printing.

Further, the blade part allows a waste, a wiper, KimWipes, or the like, which is disposed outside a range of the roll movement in the second direction, to independently clean the blade without consumption of printing time while printing on the printing material if necessary, and thus clean printing may be achieved.

Further, a starting ink line linearly supplied on the transfer plate from an ink supply starting point to an ending point, which is a movement range of the ink supplying unit, is not in a range of roll movement when the roll moves in the first direction. That is, the ink supplying unit 200 moving in the second direction performs a squeezing operation using the blade by supplying the ink to the transfer plate and moving in the second direction.

Further, when the blade is detached from the ink in the final squeezing, the ink remaining behind the blade is divided into the transfer plate or the blade according to the intermolecular force due to intermolecular force among molecules of the blade, the transfer plate, and the ink and becomes a remaining ink line. Similar to the starting ink line, a position of the final blade (a position of the remaining ink line) in squeezing should not be in a range of roll movement in the first direction. Therefore, a movement distance in the second direction of the blade should be more than a length of the second direction of the roll so as not to be in a range of roll movement.

The roll moves on the transfer plate while transferring the ink so that the starting ink line and the remaining ink line are not in a range of movement in the first direction.

Since the roll enters a printing area through a transfer area, each of the squeeze unit and the ink supplying unit may individually move, and an operation of supplying ink to the transfer plate can be performed for the next printing as described above.

To reduce the remaining ink line, as described above, operations of moving a blade and squeezing in the direction opposite to the second direction are additionally performed, and thus quality of printing can be maintained, the roll can be protected, and economic feasibility of ink supply can be increased.

Figure 9:
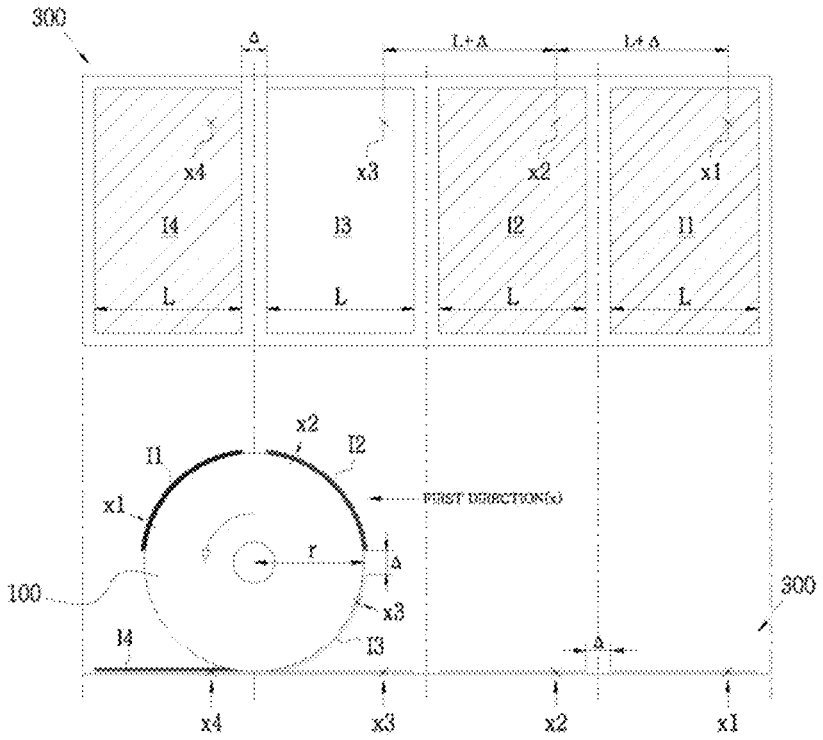
FIG. 9 is a view illustrating a state of a multi-colored ink transferred to a roll and a length for each element of a transfer plate and a roll.

FIG. 9 shows an overall state in which ink is transferred from the ink transfer plate 310 to the roll while the roll 100 moves in the first direction.

In FIG. 9, the inks on the ink transfer plate 310 have a width L and have a gap Δ formed therebetween. As described above, the ink is transferred from the transfer plate 310 to the roll 100 by upward force based on intermolecular force between the ink and the roll 100 and fluid dynamics (fluid-equation).

Based on this, a radius r of the roll 100 shown in FIG. 9 is greater than or equal to $[N(L+\Delta)+\delta]/(2\pi)$. The embodiments of the present invention will be described under the assumption that the radius r of the roll is equal to $[N(L+\Delta)+\delta]/(2\pi)$ for convenience of description.

In this case, N refers to the number of colors used for printing or the number of colors when a stereoscopic printing material has a different shape but the same color, for example, when the stereoscopic printing material is printed with the same color in an overlapping manner once more by rotating in a θ direction. N may be the number of transfer plates. For example, in the embodiment in FIGS. 1 to 4, since the ink portions I1, I2, I3, and I4 of different colors are used, N is 4. In the case of the stereoscopic printing material rotating in the θ direction to be described below, since the stereoscopic printing material is printed with the same color once more, N is 8 (4*2=8). For simplicity of description, the embodiment of the present invention will be described under a condition of N=4 without rotation in the θ direction.

As described above, L refers to a width of ink applied on the transfer plate, the ink has the same width on each of the transfer plates under the assumption that the width is the same even when printing is performed in different directions without rotation in the θ direction for simplicity of formula, and A refers to a gap between the transfer plates (ink) for preventing colors of the inks from being mixed. In this case, δ refers to a fine correction amount depending on a pressure of the roll by a minimum change (Nip) in a radius generated when an elastic roller is in contact with the transfer plate and the printing material. In the case (δ=0) of an extreme case in which the above-described Nip is not generated, a circumferential length of the roll 100 is greater than or equal to the sum of lengths in the first direction of the predetermined gaps between the ink transfer plates.

The circumferential length of the blanket roll 100 will be shown by the following formula.

$$2\pi r \geq \left(\sum_{i=1}^{N}(Li) + \sum_{j=1}^{N}(\Delta j)\right) + \delta \quad \text{[Formula 1]}$$

In this case, $L_i$ refers to a length in the first direction of the $i^{th}$ transfer plate, and $\Delta_j$ refers to a length of a gap between the $j^{th}$ transfer plate and the next plate in the first direction.

In FIG. 9, since each of the ink transfer plate 310 has the same size, printing position points x1, x2, x3, and x4 on each of the ink transfer plates are separated distances L+Δ from each other in the first direction x. Therefore, in the printing operation to be described below, the inks transferred to the points x1, x2, x3, and x4 for the same point on the printing material are printed to overlap each other.

As described at a bottom of FIG. 9, when the roll 100 moves in the first direction while making one rotation, the ink on the transfer plate 310 is transferred to the roll, and a task of printing on the printing material starts. That is, the roll 100 moves in the first direction by making one rotation, and the ink on at least one transfer plate is transferred to a surface of the blanket roll.

Figure 10:
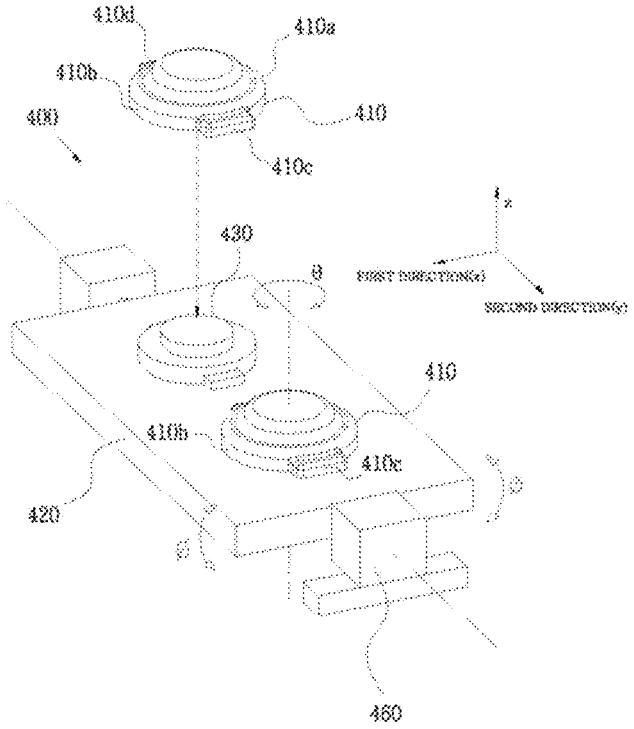
FIG. 10 is a view illustrating a printing unit including a stereoscopic printing material.

FIG. 10 shows the printing unit 400, and a stereoscopic printing material 410 with thickness is shown as a printing material, but the printing material is not limited thereto, and the present invention may be applied to a two-dimensional printing material or a cylindrical printing material.

The printing unit 400 is positioned in front of the roll 100 to which the ink is transferred through the transfer unit 300 in the movement direction (the first direction) between the pair of guide rails. In FIG. 10, the printing unit 400 includes a plate-shaped printing material support 420 and a stereoscopic printing material 410 fixed on the printing material support.

As the method of fixing the printing material 410, when the printing material has a flat surface, a position fixing member, such as a double-sided tape, a fixing unit, and the like, or a vacuum pressure may be used in the same manner as the above-described transfer plate. However, when the printing material 410 is a stereoscopic printing material, it is preferable that a separate fixing member 430 is provided to fix the stereoscopic printing material on the support 420. To print a large amount of printing material, it is necessary that the printing material is easily attached to or detached from the support, and a position of the printing material should be firmly fixed during printing. According to the exemplary embodiment, the fixing member 430 is an organic matter, such as plastic, manufactured by a three-dimensional (3D) printer and having a shape corresponding to an inner surface of the printing material. When the fixing member is manufactured by the 3D printer, a fixing member optimized for printing materials of various shapes can be easily manufactured.

Further, as a main feature of the present invention, color printing and coloring can be performed on a three-dimensional stereoscopic material manufactured by a 3D printer.

Figure 11:
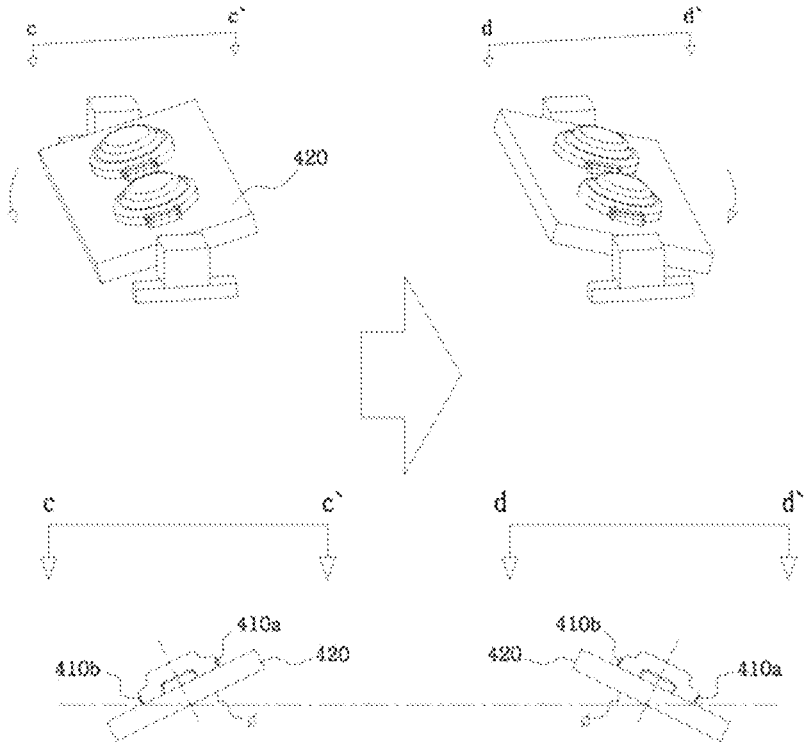
FIG. 11 is a view illustrating a printing material support vertically rotating in a direction orthogonal to a first direction.

FIG. 11 is a view illustrating a state in which the printing material support 420 is inclined upward or downward with respect to the first direction.

The printing material support 420 may be inclined, by the rotating unit 460, a predetermined angle φ upward or downward with respect to the first direction, for example, a motor and the like, provided on both sides or one side of the printing material support 420 (hereinafter, referred to as a vertical rotation of the printing material). The configuration is very effective particularly when the printing material is a stereoscopic printing material with thickness (see FIGS. 11 and 16). That is, when the printing material is generally in a horizontal state, printing can be effectively performed even on portions 410*a* and 410*b* that are not sufficiently printed due to a thickness (height) of the printing material by making the printing material inclined as described above.

Figure 16:
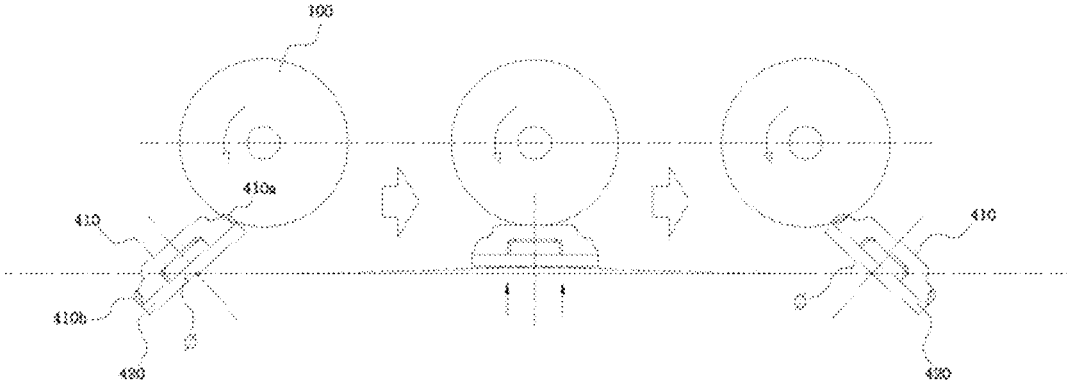
FIG. 16 is a view illustrating the printing material support in FIG. 11 vertically rotating to correspond to a height of a stereoscopic printing material and a gap between rolls.

In FIG. 16, the printing material support 420 is inclined a predetermined angle φ upward or downward with respect to the first direction, and the roll 100 moves in the first direction while rotating without vertical movement. When the printing material is stereoscopic, printing can be performed even on the portions 410*a* and 410*b* that are difficult to be printed due to a feature in which the printing material support 420 is inclined.

In this case, since a contact point between the printing material and the roll is changed according to an inclination of the printing material, the printing material should be inclined while maintaining an optimal printing distance. In FIG. 16, it is understood that a printing unit height adjusting unit 450 maintains the optimal printing distance by vertically moving according to an inclination of the printing material.

The printing unit 400 includes the printing unit height adjusting unit 450 provided at a lower end thereof so as to adjust a vertical height of the printing material support 420. Further, the printing unit further includes a separate guide rail separately from the guide rail so that the printing material support 420 moves in the first direction. The printing material support 420 allows a vertical movement performed by the printing unit height adjusting unit 450 and a horizontal movement performed by the guide rail 110 to be performed independently from each other.

Figure 12:
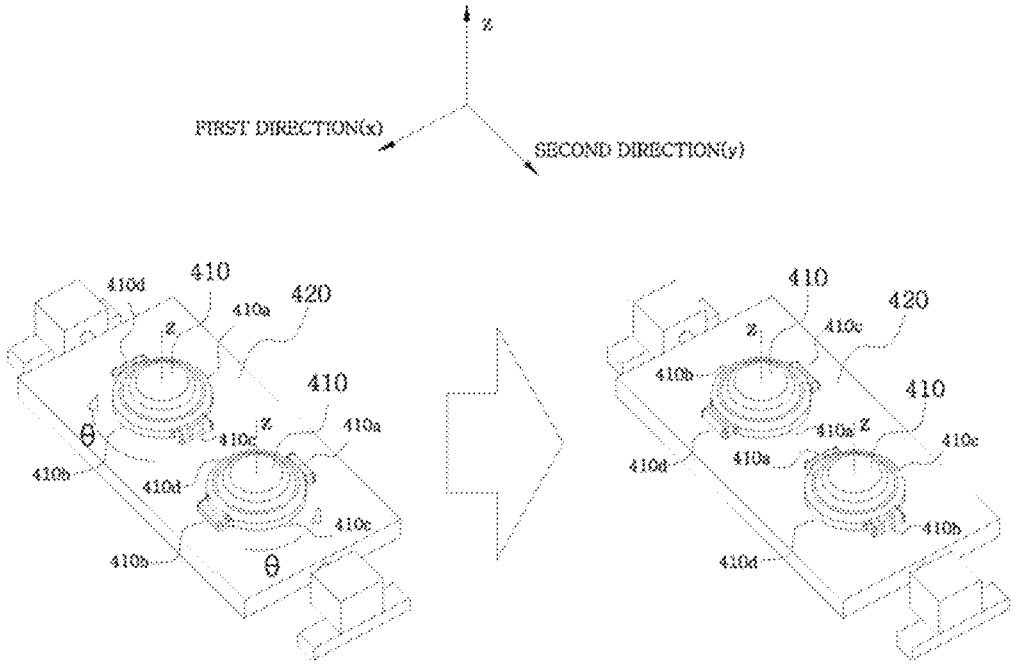
FIG. 12 is a view illustrating each printing material on a printing material support horizontally rotating on an axis in a z-direction.

In FIG. 12, the printing material 410 on the printing material support 420 rotates a predetermined angle θ about a third direction (z axis) on the support 420 (hereinafter, referred to a horizontal rotation of the printing material). As described below, when the printing material is a stereoscopic printing material, printing is not performed by printing of the roll 100 in the first direction. It is preferable that a rotating unit is provided on the printing material support 420 for the horizontal rotation of the printing material, but the printing material may be manually rotated without a separate horizontal rotating unit.

Figure 13:
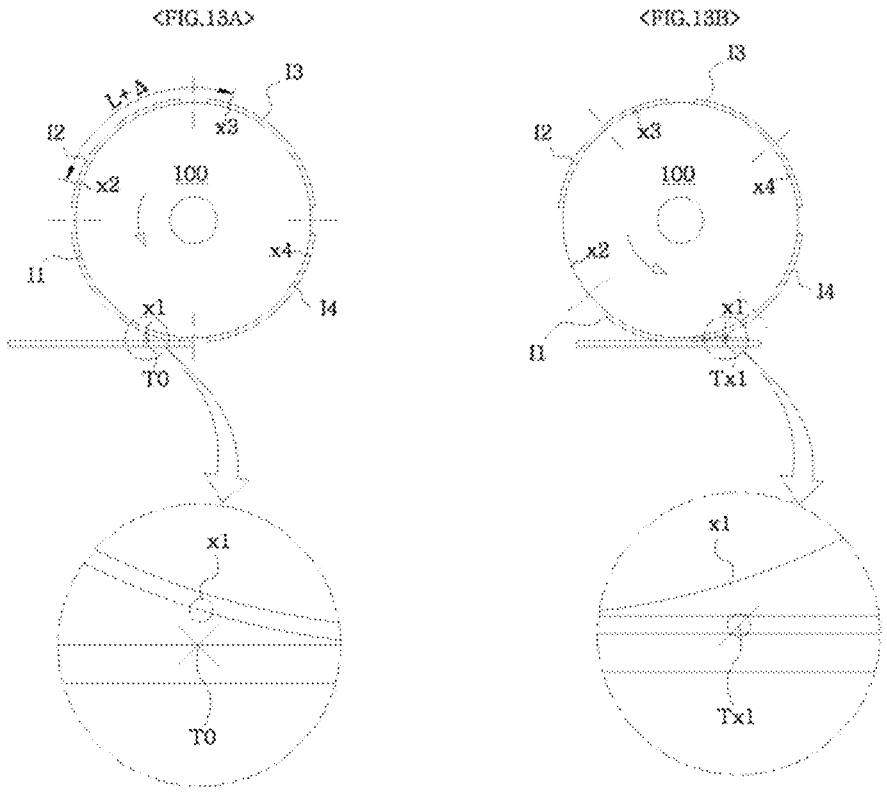
FIG. 13 is a view illustrating a first ink portion printed on a flat printing material.

FIG. 13 is a view illustrating the roll printing the first ink portion I1 on the printing material. Although a description will be made in FIG. 13 based on a flat printing material for convenience of description, this is equivalently applied to a cylindrical printing material or a stereoscopic printing material as described below. For the simplicity of drawings, the printing material support and the printing unit height adjusting unit will be omitted in FIG. 13.

In FIG. 13, a description of a printing method will be made based on x1, x2, x3, and x4 described in FIG. 9. FIG. 13 is a start of a series of multi-color printing operations to be described below in FIGS. 14 and 15. For convenience of description, the length in the first direction of the stereoscopic printing material 410 is equal to L+Δ, but may be less than L+Δ according to a required printed area.

FIG. 13A shows a state right before the first ink portion I1 is printed on a flat printing material 410 after the ink is transferred from the transfer unit 300 to the roll 100. In FIG. 13, the roll 100 moves in the first direction while rotating in a counterclockwise direction. In FIG. 13, T refers to a target position to be printed so that x1, x2, x3 and x4 overlap each other. In FIG. 13A, since ink is not yet printed, T is represented by T0. In an enlarged view on a bottom of FIG. 13A, the roll 100 moves in the first direction while rotating, and thus ink on x1 of the roll is printed on a material to be printed T0. FIG. 13B is a view illustrating a state right after the ink x1 (I1) is printed at the position T0. The ink represented by a circle in FIGS. 13A and 13B is moved from the roll to the material to be printed Tx1 to indicate that the ink is printed. After the ink x1 is printed, T0 is represented by Tx1.

Figure 14:
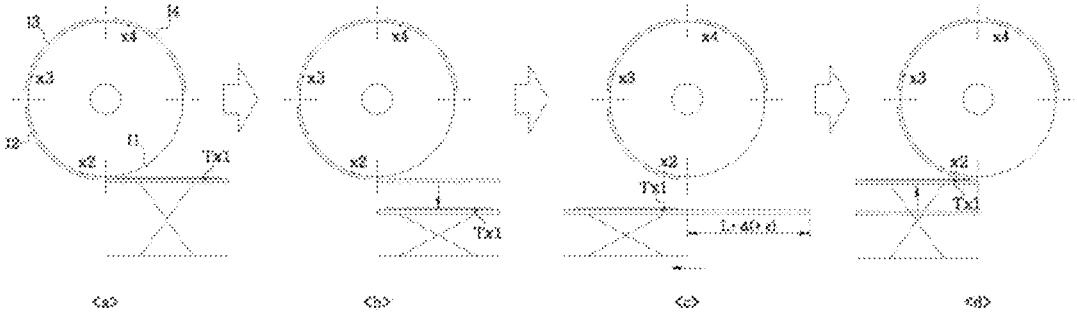
FIG. 14 is a view illustrating a printing unit horizontally moving to print a second ink portion after the first ink portion is printed.

To print the second ink portion I2, the printing material should be moved to a position corresponding to FIG. 13A while the roll 100 stops rotating and moving in the first direction. Hereinafter, FIG. 14 is a view illustrating the printing unit (printing material) moved to the next printing position before the second ink portion I2 is printed.

FIG. 14A is a view illustrating a state right after the first ink portion I1 is completely printed on the printing material. As shown in FIG. 13, since the ink x1 is printed on the printing target position T, the printing target position T is represented by Tx1. In the drawings, the roll 100 rotates a quarter of a turn and moves horizontally $2\pi r/4$ in the first direction.

FIG. 14B is a view illustrating the printing material being vertically moved downward. When the printing material is horizontally moved in the first direction by a linear slider and the like, the printing material touches the roll with the same height as the printing material, and thus the printing material vertically moves a minimum distance downward. The printed unit includes a printing unit height adjusting unit 450. The printing unit height adjusting unit 450 may use all well-known configurations to vertically lift and lower the printing unit using a driving unit such as a motor and the like.

FIG. 14C is a view illustrating that the printing material, vertically moved downward, moves horizontally in the first direction. In this case, a horizontally moved distance refers to $2\pi r/4$, that is, $(L+\Delta)+\delta/4=L+\Delta+\varepsilon$ $(\varepsilon=\delta/4)$, equal to a distance rotated and moved by the roll 100 so that the ink portion I2 is printed at the same position as the first ink portion I1 to overlap the first ink portion I1. In this case, as described above, $\delta$ refers to a change according to a fine change in a length generated when the elastic roller is in contact with the transfer plate or the printing material. Since each of the four ink portions I1, I2, I3, and I4 represents a quarter of a diameter of the roll 100, $\varepsilon$ refers to a value obtained by dividing $\delta$ by 4.

FIG. 14D illustrates a state in which the printing unit is vertically moved upward by the height adjusting unit 450 and the second ink portion I2 is ready to be printed.

Figure 15:
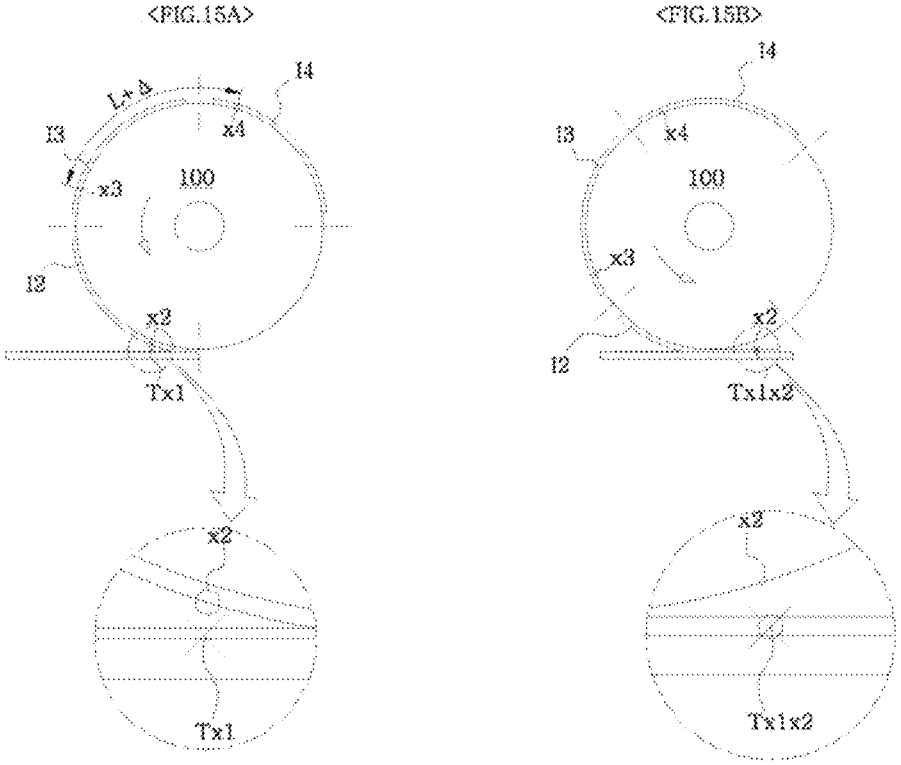
FIG. 15 is a view illustrating the second ink portion printed to overlap the printing material on which the first ink portion is printed in advance.

FIG. 15 is a view illustrating the second ink portion I2 printed by the printing unit vertically moved (see FIGS. 14B and 14D) and then horizontally moved (see FIG. 14C) immediately after the second printing preparation operation shown in FIG. 14 is completed.

In the method of printing the second ink portion I2, a difference from the method in FIG. 13 is that the first ink portion I1 in FIG. 13 is printed on the printing unit. A target position at which the ink x1 is printed is shown as Tx1 in FIG. 13, and the roll 100 is rotated in the counterclockwise direction by 90° when compared to FIG. 13. Although not shown in FIG. 15, the roll 100 is horizontally moved $2\pi r/4$, that is, $(L+\Delta)+\delta/4=L+\Delta+\varepsilon$ in the first direction when the first ink portion in FIG. 13 is printed.

Since the printing material in FIG. 14 is horizontally moved $L+\Delta+\varepsilon$ in the first direction, the target position Tx1 on which the ink I1 is printed is moved to the first direction while the roll 100 rotates in FIG. 15A, the ink x2 of the second ink portion I2 is printed at the target point Tx1. In FIG. 15B, the point is represented by Tx1*x*2 to indicate that the two inks x1 and x2 are printed at the target position to overlap each other after the printing.

As shown in FIG. 14, the printing material is horizontally moved $L+\Delta+\varepsilon$ in the first direction to print the third ink portion I3 (Tx1*x*2*x*3), and finally, the printing material is horizontally re-moved $L+\Delta+\varepsilon$ in the first direction to print a fourth ink portion I4 (Tx1*x*2*x*3*x*4).

As described above, assuming that the four ink portions are colors based on a CMYK color table, any color (multi-color) can be printed on the printing material with a required pattern by combining the four inks I1, I2, I3, and I4. Above all, multi-color printing can be performed in one printing cycle (one rotation of the roll 100), and thus printing time can be reduced, and mass production can be performed.

Figure 17:
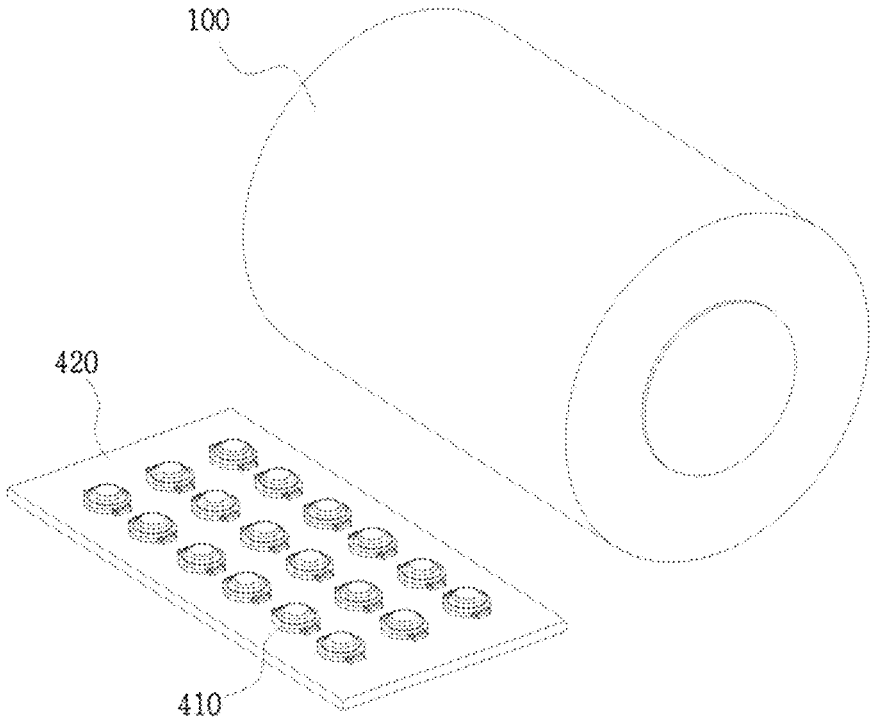
FIG. 17 is a view illustrating a plurality of printing materials disposed in parallel on a printing material support in a line in a vertical and/or horizontal direction.

Referring to FIG. 17, as another embodiment of the printing unit 400 according to the present invention, the printing units are provided on a plurality of printing material supports in first and second directions when the printing material is small, and thus printing can be performed on a large amount of printing materials at a time.

For example, when a length in the second direction of the printing material 410 is short, a plurality of printing materials may be disposed in the second direction orthogonal to a movement direction (the first direction) of the roll 100. When a length in the first direction of the printing material 410 is short, or a printing pattern is the same in a whole ink area, a plurality of printing materials may be disposed in the first direction. In any of the cases, the sum of lengths in the first direction of all printing materials should be less than or equal to L. When a size of printing material itself is much smaller than one ink portion, the printing materials are disposed in parallel in both the first and second direction, and thus productivity per one printing cycle can be increased.

Although the above-described printing method is relatively simply described, it is preferable that UV irradiation is quickly performed after printing of each color to prevent the printed ink portion from being moved to other ink portions on the roll. Generally, photon energy is selectively applied to a molecule on an originally low energy orbit of antibonding orbital $\pi^*$ to cause a transition of an electron so as to increase overlap probability of an electron cloud and make an reaction, and thus ink is cured by UV rays. Therefore, ink with an organic matter matching with a frequency of UV rays can be cured very quickly.

Figure 18:
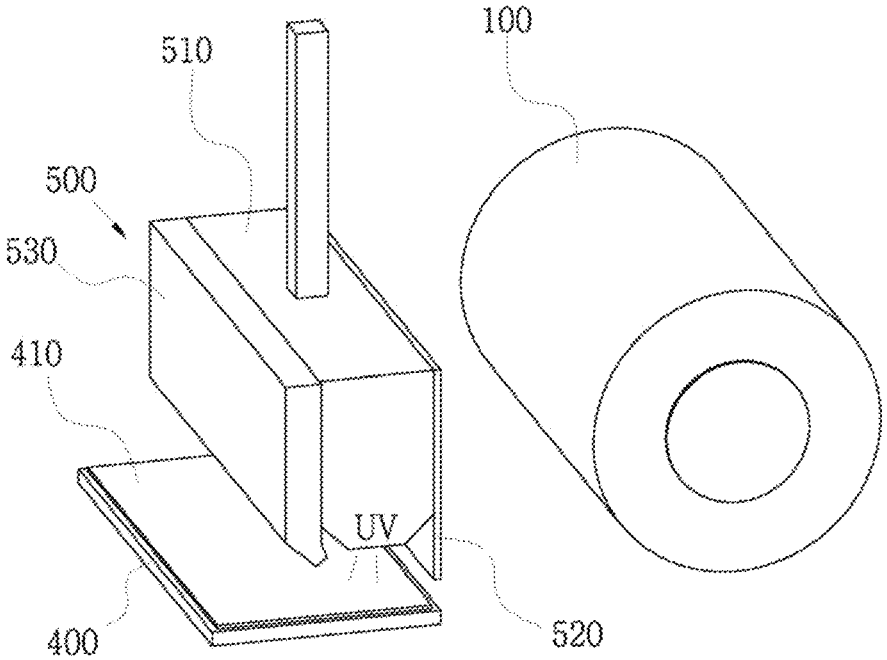
FIG. 18 is a view illustrating a drying unit.

FIG. 18 illustrates the drying unit 600 drying ink printed on a printing material.

As described above, since various colors or various kinds of inks are printed on the same printing material in one printing cycle to overlap each other, it is necessary that the ink is dried after every color printing and before the ink is printed to overlap. After a process of printing all inks is completed according to a type of inks or a feature of the printing material, the inks can be dried at once. For example, when the same color is re-printed by 0 rotation after the printing, UV irradiation is not necessary.

First, although a configuration of the drying unit is changed according to a feature of ink, in the present invention, it will be assumed that UV ink is used. Since the UV ink can be dried quickly based only on the principle of irradiating UV rays to the ink, a printing speed is increased, thereby facilitating mass production.

As shown in FIG. 1, the drying unit 600 is positioned in a movement direction of the roll 100, that is, on an extending line in the first direction. However, the drying unit is not limited thereto, and according to the present invention, may be disposed in a direction opposite to the first direction with respect to the roll 100. As the exemplary embodiment, as described below, the drying unit 600 includes a fixed-type fixed to a predetermined position and a movable type moving along movement of the printing unit 400.

The drying unit 600 includes a UV irradiating unit 610 irradiating UV rays and a UV blocking unit 620 having a strip-shape and blocking UV rays between the UV irradiating unit 610 and the roll 100 so as not to be irradiated to other positions except the printing material, and particularly, to the roll 100. Selectively, the drying unit 600 may include a cooling unit 630 to prevent the printing material from being degraded, deformed, and discolored due to heat generated by the UV rays.

Figure 19:
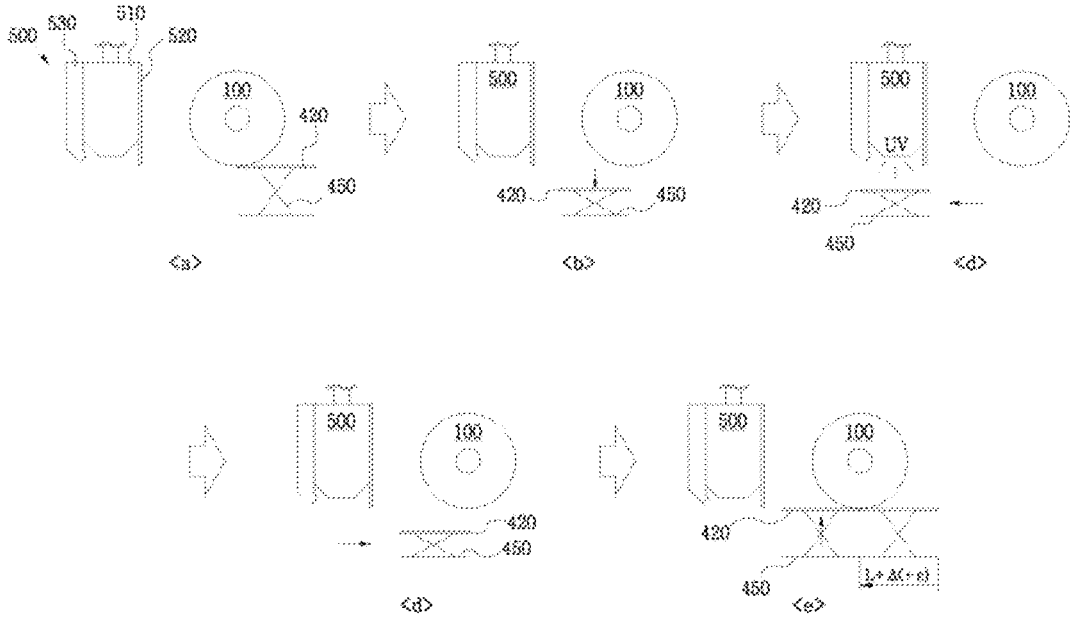
FIG. 19 is a view illustrating a printing material moving to a position at which a second ink portion is printed, after the first ink portion is printed and then ink thereon is dried.

FIG. 19 is a view illustrating an example of the fixed-type drying unit 600.

FIGS. 19A and 19B show the drying unit 600 disposed on an extension line in the first direction of the roll 100 in FIGS. 14A and 14B. Similar to FIG. 14, the printing unit 400 allows the printing unit height adjusting unit 450 to vertically move the printing material on which the first ink portion I1 is printed downward. The printing unit 400 is moved to a position at which the second ink portion I2 is printed (horizontally moved L+Δ+ε in the first direction) in FIG. 14, but is horizontally moved to a position at which the drying unit for drying is positioned in FIG. 19C. The drying unit 600 allows the UV irradiating unit 610 to irradiate UV rays to the printing material and allows the cooling unit 630 for cooling to selectively perform a cooling operation. When UV rays are irradiated, the UV blocking unit 620 is disposed between the UV irradiating unit 610 and the roll 100 so that UV rays are not irradiated to the inks I2, I3, and I4, particularly I2 and I3, on the roll 100 that are not printed on the printing material yet. In FIGS. 19D and 19E, the dried printing unit is horizontally moved to the same position as in FIG. 14C (a position moved L+Δ+ε in the first direction from the position at which the first ink portion is printed). When UV irradiation is performed for the number of colors in a short time, repeating of continuous printing may be completed in one rotation of the roll.

When the fixed-type drying unit is used as shown in FIG. 19, a distance that the printing unit should be horizontally moved every ink printing is longer, and thus printing time is increased up to 4r/V (V is a movement average speed, and r is a radius of roll).

Figure 20:
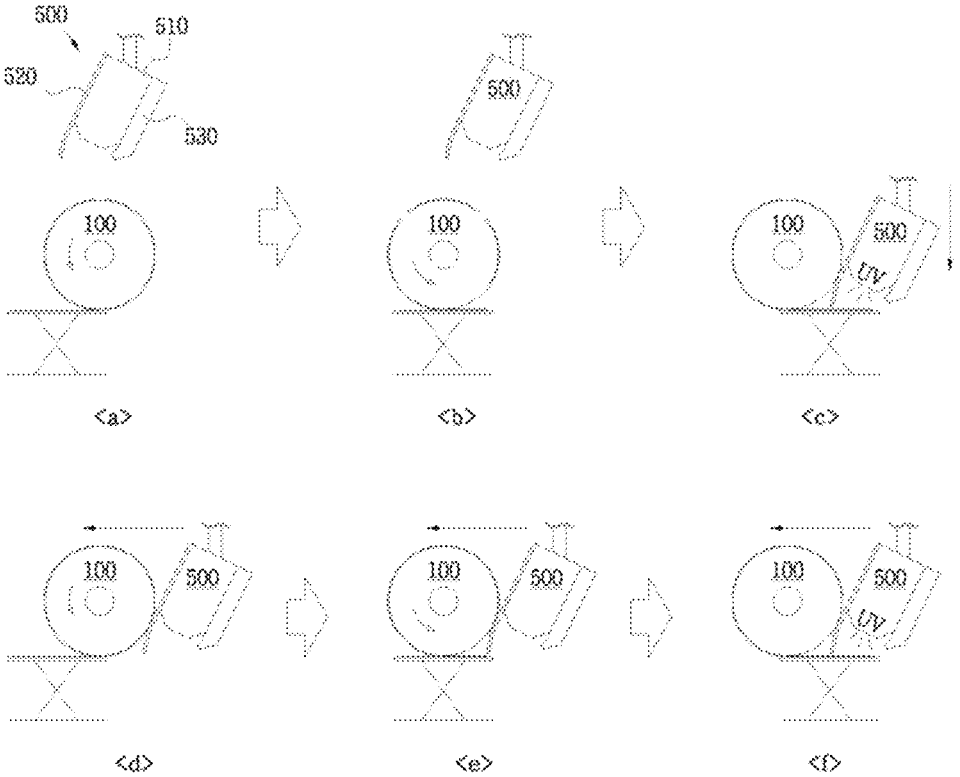
FIG. 20 is a view illustrating a moving-type drying unit, which is moving according to movement of a roll, according to another embodiment.

FIG. 20 is a view illustrating the moving-type drying unit moving with the roll 100 in the first direction.

The drying unit 600 in FIG. 20 is disposed in the direction opposite to the first direction with respect to the roll 100 unlike the fixed-type drying unit in FIG. 19. It is preferable that the drying unit is movable in a vertical direction (z direction) higher than a diameter (2*r*) of the roll because the movement of the roll 100 should not be disturbed when the ink is transferred from the transfer unit 300 to the roll after printing of the first ink portion I1. However, the drying unit is not limited thereto and may be moved behind and along the roll 100 even when transferring is performed on the transfer unit of the roll 100. In any of the cases, after the first ink portion I1 is printed, the drying unit 600 is moved with the roll 100 behind the roll 100 in the first direction.

The moving-type drying unit 600 shown in FIG. 20 can immediately perform a drying task after printing on the printing material on which the printing is completed without a separate horizontal movement while moving with the roll 100 in the first direction, and thus a printing speed of the moving-type drying unit 600 is faster than that of the fixed-type drying unit in FIG. 19.

Further, the UV blocking unit 620 for blocking UV irradiation for the roll 100 is disposed between the UV irradiating unit 610 and the roll 100.

Hereinafter, embodiments of the multi-color gravure offset printing device according to the present invention will be described in detail according to three types of printing materials.

First, as a first embodiment, a case in which the printing material is a flat printing material will be described.

Four colors are applied to the inside of the transfer plate 310 installed in the transfer unit 300, and the roll 100 rotates and moves horizontally in the first direction so that ink is transferred to the roll. In the same manner as in the embodiment, a length of each of the ink portions I1, I2, I3, and I4 is L, and the ink portions have a distance Δ formed therebetween. The roll 100 moves horizontally to the printing unit 400 while rotating in the first direction. Hereinafter, the printing material will be described based on the assumption of a flat printing material such as a solar cell. In this case, the printing material is not a flat surface that does not have height variations at all but is a flat surface that does not have height variations significant enough to affect printing (about 1 mm or less), for example a semiconductor surface including paper and a solar cell.

The roll 100 approaches the printing material fixed to the printing plate support by a linear actuator or the like while being put on a slider of the first guide rail. In this case, the flat printing material may be fixed by a fixing unit, such as a double-sided tape, a vacuum, a jig, or the like, in the same manner as the above-described method of fixing the transfer plate. When the roll rotates and moves horizontally in the first direction while a lower end of the roll is in contact with the printing material positioned to face the roll, printing is performed.

When a portion at a predetermined position x1 of the first printed portion I1 is printed (Tx1) on the printing material, the printing material is moved downward by the printing unit height adjusting unit 450 and moves horizontally (and re-moves upward) L+Δ+ε in the first direction while the roll 100 stops rotating and moving horizontally. When a pressure is low not enough to generate Nip of the roll 100 on the flat printing material and the transfer unit, ε is close to 0. When the roll 100 repeatedly rotates and moves horizontally, printing is performed on the second printed portion I2. In this case, since the printing material moves L+Δ+ε in the first direction, a predetermined position x2 of the second printed portion I2 is printed (Tx1*x*2) to overlap the ink x1. Similarly, since the four printed portions I1, I2, I3, and I4 overlap each other in four layers, multi-color printing can be performed.

Figure 21:
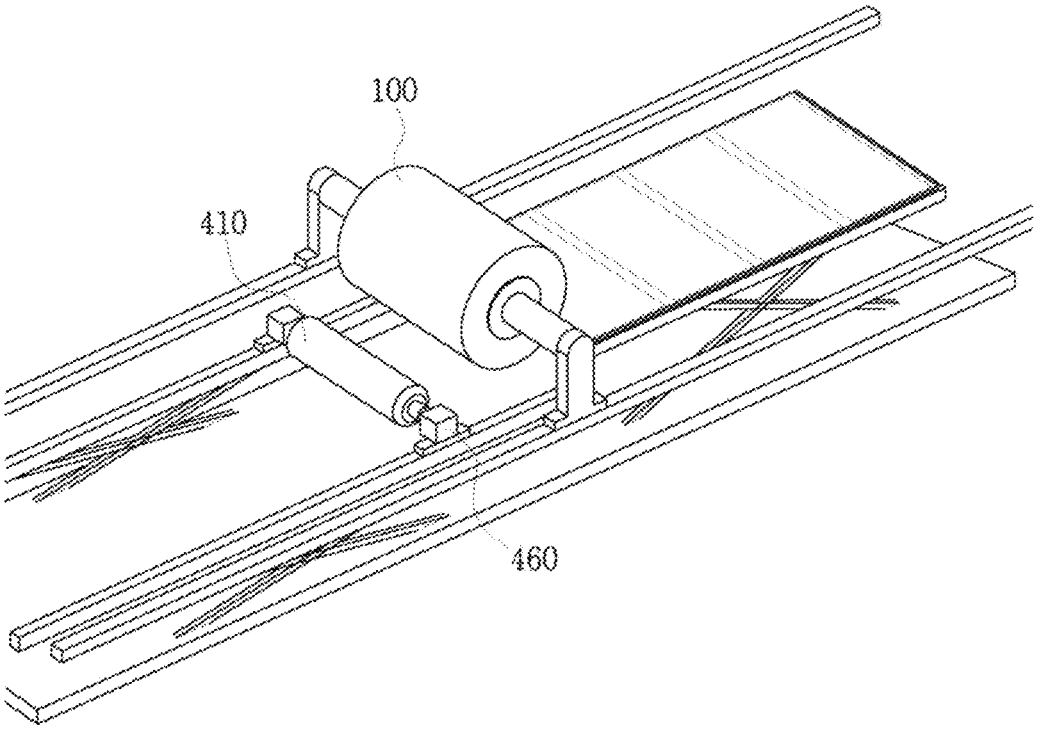
FIG. 21 is a view illustrating a printing unit in the case of a cylindrical printing material.

As a second embodiment, a case in which the printing material is a cylindrical printing material will be described with reference to FIG. 21. Since a description that the roll 100 transfers ink from the transfer plate is the same as in the first embodiment, the same description will be omitted. For example, a plastic bottle, such as a cosmetic bottle, and a circumferential surface with height variations are included in this case.

A difference from the first embodiment is that a rotating unit 460 is provided at any one or both ends of the cylindrical printing material oriented in a horizontal direction to rotate the cylindrical printing material 360 degrees an axis in the second direction (a longitudinal direction of the cylindrical printing material). In this case, a rotation direction of the printing material is a direction opposite to the rotation direction of the roll 100. That is, when the roll 100 rotates in a counterclockwise in the embodiment, the cylindrical printing material rotates in a counterclockwise direction (reversely). The rotation of the cylindrical printing material is synchronized with the rotation of the roll 100 so as to be controlled at a constant speed so that a portion at which the cylindrical printing material is in contact with the roll does not slide. Further, the rotating units installed on both ends of the cylindrical printing material include a fixing unit so that the printing material does not slide.

The method of printing the first ink portion I1 is the same as in the first embodiment except that the cylindrical printing material rotates with the roll. That is, the length of the printing material in the second embodiment refers to a circumferential length of the cylinder.

Similar to the first embodiment, the cylindrical printing material vertically moves downward while the roll 100 stops, horizontally and vertically moves to the printed position of the second ink portion I2, and printing preparation of the second ink portion is finished. The roll 100 re-rotates and moves horizontally to return to the same position as the position Tx1 at which the first ink is printed, and the second ink is printed (Tx1*x*2) with a changed phase of a rotation angle φ of the printing material.

Hereinafter, another embodiment of a cylindrical printing material will be described with reference to FIG. 22.

In the above-described second embodiment, since the cylindrical printing material moves downward to print a second printed portion, moves horizontally L+Δ+ε, and re-moves upward, there is a problem in which the printing time is increased up to about 4 πr/V as the time for moving the printing material takes (V is a movement average speed, and r is radius of roll). Further, the printing time is as long as the printing material takes to move to and return from a position at which the drying unit 600 is positioned.

When the printing material is cylindrical, unlike a flat printing material in the first embodiment of the present invention or a stereoscopic printing material in the third embodiment, the cylindrical printing material moves with the roll 100 and rotates while being in contact with the roll 100, and thus multi-color printing can be performed. That is, in the case of another embodiment, the printing material is not horizontally moved while printing is performed on the printing material, but in the case of the cylindrical printing material, the printing material moves in the first direction at the same speed as that of the horizontal movement of the roll 100 while the printed is performed, and it is not necessary to horizontally move the printing material, and thus it is not necessary to move a separate printing material for drying.

Figure 22:
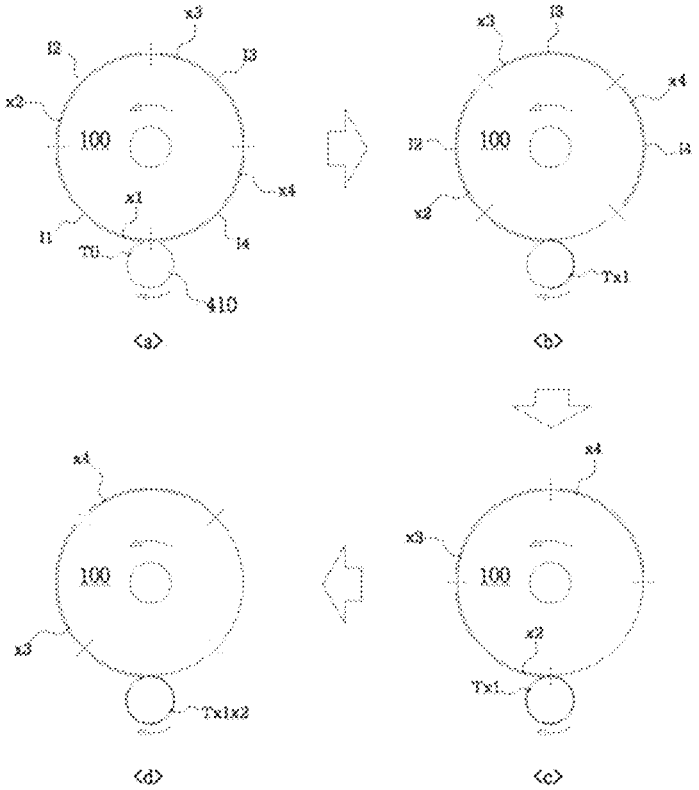
FIG. 22 is a view illustrating a second ink portion printed, after the first ink portion is printed on a cylindrical printing material, to overlap the cylindrical printing material on which the first ink portion is printed in advance.

FIG. 22A shows a state in which printing of the first ink portion I1 starts while the cylindrical printing material 410 is in direct contact with a lower portion of the roll 100 to which the ink is transferred. Similar to the flat printing material, the roll 100 moves in the first direction while rotating, and the cylindrical printing material synchronized to the roll 100 rotates in a direction opposite to the roll 100 and moves horizontally at the same speed as the movement speed in the first direction of the roll 100, and thus the first printed portion I1 is printed on the cylindrical printing material (see FIG. 22B). In this case, the speed refers to a relative speed of a surface that is in contact with the flat surface and does not refer to an angular speed between the roll and the cylindrical printing material. Since the circumferential length of the cylindrical printing material in FIG. 22 is a quarter of the circumferential length of the roll 100, the cylindrical printing material makes one rotation to be in the same state (horizontally moved L+Δ+ε) as in FIG. 22A (see FIG. 22C) when the roll 100 rotates a quarter of a turn. In FIG. 22C, similar to the first embodiment, the first printed portion I1 is printed, and a target printing point T is presented by Tx1. Similar to printing of the first printed portion, the second printed portion I2 is printed while the roll 100 rotates and moves horizontally, and the second printed portion is printed while the cylindrical printing material 410 rotates reversely and moves horizontally. Accordingly, a position at which the first printed portion is printed is the same as a position at which the second printed portion is printed, and thus, the ink x2 is printed to overlap the target point Tx1, and the target point Tx1 becomes Tx1Tx2.

Figure 23:
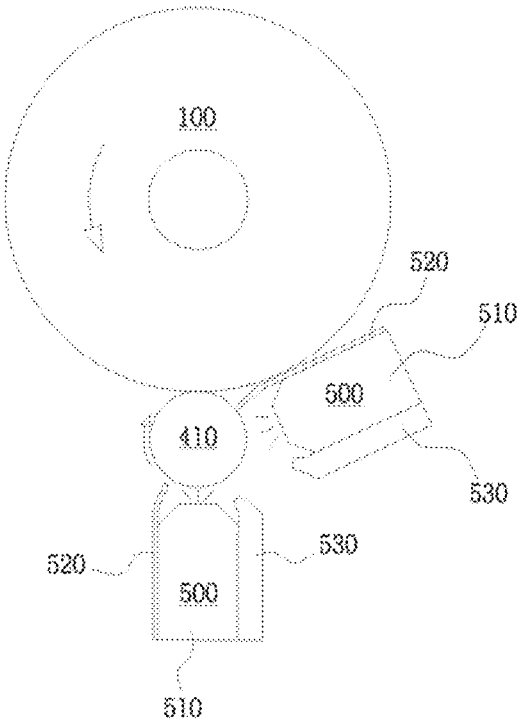
FIG. 23 is a view illustrating a drying unit in the case of a cylindrical printing material according to still another embodiment.

Referring to FIG. 23, the drying unit 600 is positioned on a lower end of the cylindrical printing material or on a front diagonal line in the first direction, and moves in the first direction while the roll 100 and the cylindrical printing material move horizontally. In this case, similar to the first embodiment, the UV blocking unit is positioned between the UV irradiating unit and the roll 100 to prevent UV from being irradiated to the ink transferred to the roll.

When the cylindrical printing material and the drying unit move with the roll in the first direction, a necessary operation including moving of the cylindrical printing material in a horizontal direction described in the first embodiment can be reduced, and since it is not necessary to move the cylindrical printing material to the drying unit, multi-color printing and drying can be simultaneously and quickly performed.

Further, particularly when UV rays are irradiated from the right direction in FIG. 23, UV ink is dried during printing, and thus printing efficiency is very high, and economical feasibility can be increased due to reduction of printing time.

As the third embodiment, a case in which the printing material is a stereoscopic printing material having various thicknesses in a z-axis will be described. However, since the third embodiment is basically the same as the first and second embodiments, the same descriptions will be omitted.

In the third embodiment, the stereoscopic printing material is a printing material 410 shown in FIGS. 10 to 12. Referring to FIG. 10, a surface almost orthogonal to the ground, that is, a z-direction of the shape of the printing material 410, is shown as unprinted surfaces 410*a*, 410*b*, 410*c*, and 410*c* (surfaces almost orthogonal in the third direction z). As described above, although electricity of the roll 100 is large, such portions are not easy to print when the printing material is put on a flat surface. That is, as a JIS-A hardness of the roll 100 is close to 0, a predetermined thickness (height) can be covered. However, when the hardness is too low, an inclined horizontal component force based on electricity of the roll for a vertical pressure is generated on the roll when printing is performed on the surface, and thus there are problems in which the roll is partially widened, printing is not clear, or the lifetime of the roller is reduced.

Therefore, in FIGS. 11 and 16, to efficiently perform printing on surfaces 410*a* and 410*b* in the first direction with respect to a direction in which the first printing material is put on unprinted surfaces, the printing material is rotated a predetermined angle φ with respect to the first direction by the rotating unit.

However, it may be difficult for the roller moving in the first direction to perform printing on the unprinted surfaces 410*c* and 410*d* even using the methods shown in FIGS. 11 and 16. Therefore, as shown in FIG. 12, it is necessary that each of the printing materials rotates a predetermined angle θ about a z-axis. In the embodiment, the predetermined angle θ is 90°, but another angle may be used if needed.

Hereinafter, a process of printing on a stereoscopic printing material including the processes will be described.

Basically, the ink is transferred from the transfer unit 300 to the roll 100 in the same manner unlike the conventional embodiment, the printing material rotates a predetermined angle about a z-axis, and thus the same ink needs to be used twice. That is, to use four colors on the printing material, in the third embodiment, two inks I and I' per one ink type I should be applied to eight transfer plates. The inks are transferred from the eight transfer plates to the roll 100. Although there are four transfer plates, two printing patterns may be carved on each of the four transfer plates. Hereinafter, for simplicity of description, description will be made based on the assumption of eight transfer plates.

When the roll approaches the printing material, the first printing I1 of the first ink portion is performed. Similar to FIG. 14, the printing material is vertically lowered by the printing unit height adjusting unit 450, moves horizontally L+Δ+ε in the first direction, is vertically re-moved, and is ready for the next printing. In this case, the printing material rotates a predetermined angle θ and 90° about a z-axis. Thus, the second printing I1' of the first ink portion is performed.

Through the processes, one type of ink is printed on the printing material, and the same ink is re-printed on the printing material horizontally rotating 90°, and thus printing is easily performed on the above-described unprinted surfaces 410*c* and 410*d*.

Importantly, to print the same color, a drying process, such as a process of irradiating UV rays and the like, is not necessary until printing of the same color is completed.

In the operation of the second printing IF of the first ink portion, when the printing moves L+Δ+ε in the first direction and rotates about the z-axis a predetermined angle θ and 90°, or the pattern of the transfer plate is rotated in the opposite direction to the first printing, the printing of the second ink starts at the same angle, and the first printing I2 of the second ink portion is performed, and thus the printing time is reduced. Similar to the first ink portion, the printing material moves L+Δ+ε in the first direction and rotates about a z-axis a predetermined angle θ and 90°, and the second printing I2' of the second ink portion is performed. Hereinafter, multi-color printing and drying are simultaneously performed on a front surface of the stereoscopic surface while the roll makes one rotation.

Since the printing method is achieved by one rotation of the roll, as long as an error of degree of horizontality in a roll movement direction (the first direction) of a linear slider or an error of control software does not occur, the printing can be performed with high precision and high reproducibility.

INDUSTRIAL AVAILABILITY

According to the present invention, gravure offset printing can be performed on various shapes of printing materials in one printing cycle. Particularly, the gravure offset printing can be performed even on a cylindrical printing material and a three-dimensional stereoscopic printing material with thickness and having a curved surface.

Further, according to the present invention, various colors of inks can be printed at the same position on each printing material to overlap each other, and thus a required color obtained by combining colors of the inks can be printed in one printing cycle.

Further, according to the present invention, since mass printing can be performed on a plurality of printing materials in one printing cycle, a printing speed can be increased, and thus, economic feasibility can be increased.

The invention claimed is:

1. A gravure offset printing device comprising:

a blanket roll having a cylindrical shape and configured to horizontally move in a first direction while rotating;

a plurality of ink transfer plates which are in contact with a lower end of the blanket roll and to which various colors of inks are applied; and a blade moving in a second direction orthogonal to the first direction while one end is in contact with the ink transfer plate so that various colors of inks are not mixed each other at the time of squeezing, wherein the blanket roll moves in the first direction while making one rotation and transfers inks on two or more transfer plates to a surface of the blanket roll, and the two or more inks transferred to the surface of the blanket roll are printed at a target point on a printing material positioned to face the blanket roll in an overlapping manner, and thus multi-color printing is performed.

2. The gravure offset printing device of claim 1, wherein, after a first ink portion is printed on the printing material, the printing material moves unidirectionally in the first direction, and the blanket roll rotates and moves a distance that the blanket roll rotates unidirectionally in the first direction without vertical movement so as to print a second ink portion on the first ink portion in an overlapping manner.

3. The gravure offset printing device of claim 2, wherein a distance that the printing material moves unidirectionally in the first direction is the same as a distance that the blanket roll moves unidirectionally in the first direction while rotating.

4. The gravure offset printing device of claim 3, wherein the distance that the printing material moved unidirectionally in the first direction and the distance that the blanket roll moves unidirectionally in the first direction while rotating are $2\pi r/N=L+\Delta+\varepsilon$, wherein N refers to the number of transfer plates, L refers to a length in the first direction of transfer plate, Δ refers to a distance in the first direction of the gap between the transfer plates, and ε refers to a value obtained by dividing δ by N wherein δ refers to a fine correction amount by a minimum change (Nip) in a radius generated when an elastic roller is in contact with the transfer plate and the printing material.

5. The gravure offset printing device of claim 1, wherein:

each of the ink transfer plates is disposed to be spaced by a predetermined gap (Δ) in the first direction; and a circumferential length of the blanket roll is greater than or equal to the sum of lengths of the ink transfer plates and a length in the first direction of the gap between the ink transfer plates.

6. The gravure offset printing device of claim 1, wherein:

a Japanese Industrial Standards (JIS)-A hardness of the blanket roll is greater than 0 and less than or equal to 40; and a rotation speed and a movement speed in the first direction of the blanket roll are in a range of 0.5 to 12 m/min on the transfer plate.

7. The gravure offset printing device of claim 1, further comprising at least two ink syringes configured to move in the first direction while the ink drops down on the transfer plate, wherein the ink syringes are disposed to be spaced apart from each other by the sum of a length in the first direction of the transfer plate and a length of the predetermined gap between the one or more transfer plate in the first direction.

8. The gravure offset printing device of claim 5, wherein a transfer plate support includes a concave part or a convex part formed to have the predetermined gap and extending in the second direction.

9. The gravure offset printing device of claim 8, wherein:

the squeeze unit includes a blade part of which one end is in contact with the transfer plate; and the one end of the blade part has a concave part, a convex part, or a flat shape formed at a position corresponding to the concave part or the convex part of the transfer plate support to correspond to a cross-section of a shape of the concave part or the convex part of the transfer plate support.

10. The gravure offset printing device of claim 1, wherein a starting ink line and a remaining ink line are not in a range of the movement in the first direction of the blanket roll.

* * * * *